United States Patent [19]

Iwai et al.

[11] Patent Number: 4,993,222

[45] Date of Patent: Feb. 19, 1991

[54] METHOD FOR BURNING GASEOUS FUEL, WHEREIN FUEL COMPOSITION VARIES

[75] Inventors: Kazumi Iwai, Mito; Akira Arai, Tsukuba; Hiromi Koizumi; Katsuo Wada, both of Hitachi, all of Japan

[73] Assignee: Hitachi, Ltd., Tokyo, Japan

[21] Appl. No.: 404,947

[22] Filed: Sep. 6, 1989

Related U.S. Application Data

[62] Division of Ser. No. 153,607, Feb. 8, 1988, Pat. No. 4,890,453.

[30] Foreign Application Priority Data

Feb. 6, 1987 [JP] Japan ..... 62-24573

[51] Int. Cl.[5] ..... F02C 3/28

[52] U.S. Cl. ..... 60/39.06; 60/39.12; 431/12

[58] Field of Search ..... 60/39.06, 39.12, 39.281, 60/39.465, 733, 746, 747; 431/12, 14, 89, 90

[56] References Cited

U.S. PATENT DOCUMENTS

| | | | |
|---|---|---|---|
| 3,486,834 | 12/1969 | Frey et al. . | |
| 3,644,077 | 2/1972 | Dimick . | |
| 4,344,280 | 8/1982 | Minakawa et al. | 60/747 |
| 4,683,715 | 8/1987 | Iizuka et al. | 60/733 |
| 4,716,719 | 1/1988 | Takahashi et al. | 60/39.06 |

FOREIGN PATENT DOCUMENTS

| | | | |
|---|---|---|---|
| 46309 | 4/1980 | Japan | 60/747 |
| 201234 | 9/1986 | Japan | 60/39.464 |
| 2175993 | 12/1986 | United Kingdom . | |

OTHER PUBLICATIONS

Patent Abstracts of Japan, vol. 7, No. 63 (M-200), Mar. 16, 1983; & JP-A-207 719 (Ishikawajima Harima Jukogyo K.K.) 12-20-1982, *Abstract*.

*Primary Examiner*—Louis J. Casaregola

*Attorney, Agent, or Firm*—Antonelli, Terry, Stout & Kraus

[57] ABSTRACT

A method and an apparatus for burning gaseous fuel, the composition of the fuel varying at times, wherein; main injection ports and sub-injection ports are arranged in such positions that the fuel injected through the sub-injection ports may be ignited by a flame formed from the fuel injected through the main injection ports; fuel passes are provided or conducting the gaseous fuel separately to the two groups of injection ports; and control valve is provided for adjusting the ratio of the fuel flow to the main injection ports to the fuel flow to the sub-injection ports; whereby the proportion of the fuel to be injected through the main injection ports is increased as the rate of burning the gaseous fuel increases.

3 Claims, 5 Drawing Sheets

METHOD FOR BURNING GASEOUS FUEL, WHEREIN FUEL COMPOSITION VARIES

This is a division of application Ser. No. 07/153,607, filed Feb. 8, 1988 (U.S. Pat. No. 4,890,453).

BACKGROUND OF THE INVENTION

1. Field of the Invention

The present invention relates to a method and an apparatus for burning gaseous fuel, like coal gas that is formed by coal gasification, wherein the fuel composition varies with the kind of fuel source used. Especially, the invention relates to a combustion method and apparatus by which stable combustion can be maintained even when the composition of gaseous fuel varies.

2. Description of the Prior Art

As described in Japanese Patent Application Laid-Open No. 57-172,229, a fuel nozzle system of the prior art comprises gaseous fuel passes and air passes arranged alternately adjacent one to another on a pitch circle, all the passes being provided with injection ports for causing the same-direction turning of fuel and air, and the gas injection ports having such areas that the dynamic pressure of gaseous fuel at the maximum flow may be equal or lower than the dynamic pressure of the air fed through the air passes.

In this system, the area of fuel injection ports is defined on the basis of the dynamic pressure of the air fed through the air passes. However, such systems are not designed by considering the case where variation occurs in the amount of air fed through the air nozzles or in the amount of inert gas present in the fuel gas. Possible variations in the conditions include the exchange of the area of air distributor ports in the burner and variation in the fuel composition. In particular, variation in the fuel composition is accompanied by variation in calorific value per a unit volume of fuel and hence the whole amount of air varies and the dynamic pressure of the air fed through the air passes. Under such conditions, variation occurs in the degree of fuel-air mixture or in the magnitude of circulating streams developed in the downstream of the fuel nozzle. These variations result in unstable flame.

In particular, gaseous fuel from a coal gasifier, that is, coal gas from a gas producer varies largely in gas composition and in calorific value with the species of raw material coal. Therefore, it is extremely difficult to obtain stable flame from coal gas by using one combustion apparatus.

In a gas turbine power plant wherein gaseous fuel from a gas producer is used, it is impossible to stop the gas turbine and exchange the fuel nozzle of the gas turbine burner or the burner itself, every time the species of raw material coal changes. In order to commercialize such a gas turbine power plant in the future, it is indispensable that the gas turbine burner can be operated continuously regardless of the species of coal gas to charge into the gas producer.

As to the prior art analogous to the present invention, there is known a powdered fuel injection burner. This burner, for instance, is provided with a nozzle system for charging powdered fuel into a gas producer and a plurality of ports for injecting a gasifying agent (e.g. air). These ports are designed so that the number of open or closed ports thereof may be controllable for the purpose of keeping the speed of injecting the gasifying agent nearly constant, this flow speed being the main factor having great effect on the gasification efficiency, even when the ratio of the powdered fuel and the gasifying agent is changed according to variation in load on the gas producer. That is, the burner has such a mechanism that the flow rate of the oxidizing agent to feed. Generally, gas turbine burners are operated with the air (oxidizing agent) flow being kept nearly constant regardless of the load. Especially in gas turbine power plants wherein coal gas is used as fuel, loads on turbines employing coal gas as fuel are at least 30% (less loads than 30% pose a problem in the stability of combustion) in most cases and the turbines will be operated at nearly constant flows of air up to 100% load. In addition, the gas temperature under varying turbine loads will be regulated by fuel control alone while the control of the amount of air or the control of the flow rate of injected air will not relate directly to turbine loads. Accordingly, the control of fuel flow will be important in gas turbine power plants.

Among gas turbine burners burning common fuels, e.g. natural gas, there is an example wherein fuel is charged in two stages to reduce the concentration of NOx discharged. Because of the high combustion rate, a good quality fuel such as natural gas can be burnt up in a short time even when charged into a mid zone of the burner. In contrast to this, a fuel such as coal gas exhibiting a low rate of combustion needs to be burnt up by maximizing the gas fuel residence time in the burner. Accordingly, it is most ideal to charge such a fuel at the top (up-stream side) of the burner.

The above stated prior art does not take into consideration the stability of flame to be maintained when the composition of fuel varies; hence there are problems in applying the above prior art to actual gas turbine power plants.

SUMMARY OF THE INVENTION

An object of the invention is to provide a gas turbine which can be operated steadily by using one burner without exchanging the fuel nozzle even when the composition of fuel varies.

Other objects and advantages of the invention will be apparent from the following description.

When variation in fuel composition is coped with without exchanging the burner or the fuel nozzle thereof, the most important technical subject is the stability of flame in the burner. Of the factors having influence on the stability of flame, the most effective factors is the rate of fuel injection from the fuel nozzle relative to the rate of air injection. This value will vary with the fuel composition. Accordingly, it is desirable that the fuel nozzle have a structure permiting altering readily the rate of fuel injection when the fuel composition varies.

Generally, the flow rate can be altered with the flow or the area of injection ports. In the case of a gas turbine, the flow of fuel is not optional but dependent on the gas turbine load. In consequence, the area of fuel injection ports is altered for the purpose of altering the fuel flow rate. The means of altering the area of fuel injection ports is to exchange the fuel nozzle or make the injection port area variable. The former means does not meet the above noted object of operating the burner steadily without exchanging the fuel nozzle. Therefore, the latter means is chosen, but it is very unfavorable to provide a variable mechanism at a high-temperature region such as the inside of the burner.

In view of the above, the following guides may lead to the solution of problems. That is:

(1) The use of a fuel nozzle is continued for its life span regardless of the fuel composition.

(2) A variable mechaniusm is not placed in a high-temperature region as far as possible.

(3) Very small amounts of fuel are varied for control as compared with the amount of air.

(4) The control means is provided at a low-temperature region or if possible, outside the fuel nozzle.

(5) The control means has a sufficiently reliable structure.

The above object can be achieved by optimizing the fuel flow passing through injection ports. That is, the necessary flow of fuel is divided into a flow (I) necessary to stabilize the flame and a flow (II) not having direct effect on the stabilization of flame. On the other hand, the positions of fuel injection ports and air injection ports are determined to be best fitted for the stabilization of flame. Fuel of the flow (II) not having direct effect on the stabilization of flame is injected through injection ports formed in such positions that the stability of flame may not be directly affected thereby, and is ignited by the stabilized flame.

The optimum proportions of the fuel flows (I) and (II) differ with the fuel composition and are determined according to the maximum fuel flow necessary or the fuel flow in rated operation.

The mechanism for controlling the proportions of the fuel flows (I) and (II) is placed upstream from the injection ports and the structure and position of the controlling mechanism are such that the fuel flow proportions can be altered without detaching the fuel nozzle.

Construction of the nozzle system as described above makes it possible to burn steadily fuel of varying compositions without exchanging the burner or the fuel nozzle.

To simplify the explanation, the following expressions are used hereinafter.

Main injection port: the fuel injection port having direct effect on the stabilization of flame.

Sub-injection port: the fuel injection port not having direct effect on the stabilization of flame.

Main pass: the fuel pass up to the main injection port.

Sub-pass: the fuel pass up to the sub-injection port.

Let us suppose provisionally that two kinds of fuels different in composition would be used. This difference in composition includes chiefly difference in the content by volume of hydrogen, that of carbon monoxide, and that of inert gas. The instability of flame caused by these differences depends mainly on the speed of mixing the fuel with the air and on the magnitude of circulating streams in the downstream of the fuel nozzle. The magnitude of each circulating stream depends on the speed of fuel injection and hence the optimum value of this speed needs to be determined according to the fuel composition. Thereupon, when the optimum area of each main injection port has been determined according to the fuel having a higher calorific value of the two kinds of fuels supposed, the fuel having a lower calorific value, when all of this fuel is passed through the main passes since the whole amount of this fuel is increased, is injected at a higher speed through each main injection port and the residence time of this fuel will be shorter. When this injection speed is excessively high, a part of the whole amount of this fuel is passed through the sub-pass and the speed of fuel injection through each main injection port is optimized, thereby prolonging the residence time to a level necessary for the combustion. In this case, the point of branching into the main pass and the sub-pass and the control mechanism for these passes are situated at positions where the control is possible without detaching the nozzle and the control mechanism is designed to have such a structure that the control will be possible also during the fuel flowing.

Construction as described above makes it possible to achieve steady burning without exchanging the fuel nozzle regardless the fuel composition and in addition permits controlling the speed of fuel injection without providing any movable mechanism in a high-temperature region, thereby elevating sufficiently the reliability of control mechanism.

DETAILED DESCRIPTION OF PREFERRED EMBODIMENT OF THE INVENTION

Figure 1:
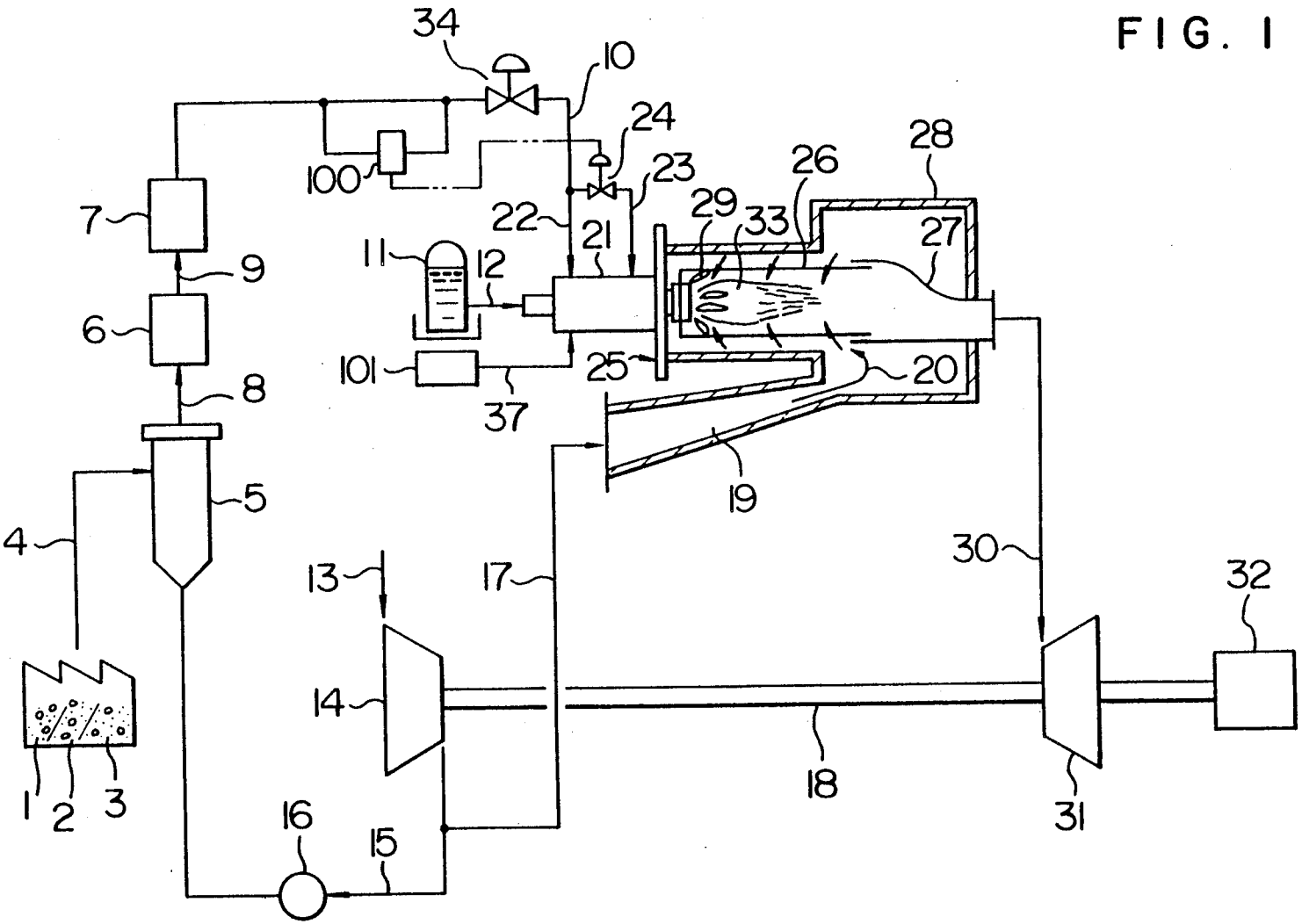
FIG. 1 is a flow diagram of a power plant using producer gas as fuel which is an embodiment of the present invention.

Referring now to the drawings, FIG. 1 is a flow diagram of a gas turbine power plant which combines a coal gas producer and a gas turbine. This system is characterized in that a part 15 of the air compressed by a compressor 14 connected to a gas turbine 31 through a shaft 18 is further compressed by a compressor 16, and fed into a gas producer 5, wherein coal 1, 2, or 3 fed is partly reacted with the fed air to produce gaseous fuel 10. Accordingly, the gas turbine 31 needs to be operated by using a gas other than the gaseous fuel (coal gas) 10, before operation of the gas producer 5. Procedure from the start to the normal operation of gas turbine 31 is as follows: The turbine 31 and the compressor 14 are first operated up to about 20% of the respective rated revolutions by an external power such as that of a Diesel engine (not depicted) for gas turbine starting, thereby pressurizing sucked air 13 and supplying it as combustion air 17 to a burner 25. Fuel 11 such as gas oil is also supplied to the burner 25 through a fuel line 12 and a gas oil nozzle in a fuel nozzle 21, and ignited to begin burning. Then, the gas turbine 31 and the compressor 14 are gradually accelerated and the part 15 of the air discharged from the compressor 14 is further pressurized by the compressor 16, and fed into the gas producer 5. One of different coals 1, 2, and 3 placed in coal stores is also fed by a feeder 4 into the gas producer 5. Gas 8 generated in the gas producer 5 is introduced into a desulfurizer 6 to be free of sulfur. The desulfurized gas 9 is introduced into a dust separator 7 to remove solids from the gas, and the purified coal gas 10 is fed into the burner 25. The operation by using fuel 11 such as gas oil is continued until the gas turbine load becomes 20–30%. Meantime, the gas producer load increases gradually and the amount of gas generated increases as well. When the gas turbine load becomes 20–30%, the purified gas 10 is introduced into a fuel nozzle 21 through the main pass 22 of a fuel feed pipe, and fed with turning into the liner 26 of burner 25 through main injection ports 44. The gaseous fuel fed into the burner liner 26 mixes with flame 33 formed previously by gas oil burning, thus starting the combustion of gas oil-coal gas mixtures. Afterward, the flow of coal gas fuel 10 is gradually increased and conversely the flow of fuel 12 such as gas oil is gradually decreased. Eventually, fuel burnt in the burner 25 is completely changed to coal gas 10, that is, fuel for operating the gas turbine 31 becomes coal gas 10 only. It may be noted that the state of burning coal gas fuel is nearly the same with the state of burning gas oil fuel.

Structure, flow, etc. in the burner are described below. A part of air from the compressor 14 is passed through a diffuser 19 placed near the outlet of the compressor 14, then is flowed in the space 20 surrounded by the burner liner 26, a tail casing 27 which conducts the combustion product gas to the turbine 31, and an outer casing 28 in the direction opposite to that of the combustion product gas stream while cooling the tail casing 27 and the burner liner 26, and fed into the burner liner 26. The fuel nozzle 21 is fixed in the burner head portion of the outer casing 28 through a seal and protruded into the burner liner 26.

A circulating stream 29 is formed downstream from the fuel nozzle 21. Flame 33 is stabilized by the circulating stream 29.

The combustion product gas is passed through the tail casing 27 and a conduit 30, and introduced into the turbine 31 to rotate it and this drives a generator 32.

Then, the action of the present inventive combustion system is described.

Coals placed in the coal store are of different species, which vary the composition of the producer gas. Therefore, the pass for purified coal gas 10 is branched, as stated before, into the main pass 22 and a sub-pass 23 and a control valve 24 is fitted in the sub-pass 23 for the purpose of controlling the ratio of the fuel flow through the main pass 22 to that through the sub-pass 23. The whole fuel flow is controlled by a flow control valve 34 fitted in the purified gas 10 pass, to meet a demand from the turbine. The ratio of the fuel flow through the main pass to that through the sub-pass is set by the control valve 24 on the basis of the rated turbine load. When this has been fixed, the above flow ratio can be secured throughout the whole range of turbine loads. When the travel (degree of opening) of control valve 24 can be varied by an external means, the ratio of the fuel flow through the main pass to that through the sub-pass can be manipulated without stopping the turbine where coal 1 is changed for coal 2.

The travel of control valve 24 may be regulated either by the output from a detector 100 which analyzes the composition of coal gas 10 and provides a signal in response to the combustion rate or in the following manner: Since the composition of coal gas from the gas producer is absolutely fixed when the species of coal used is definite, the combustion rates of coal gases produced from various species of coal are previously determined by experiments and the operator, on every change of coal species, regulates the control valve 24 by reference to the obtained data so that the branched-flow ratio may fit the combustion rate of coal gas produced from the coal to be used thereafter.

Figure 2:
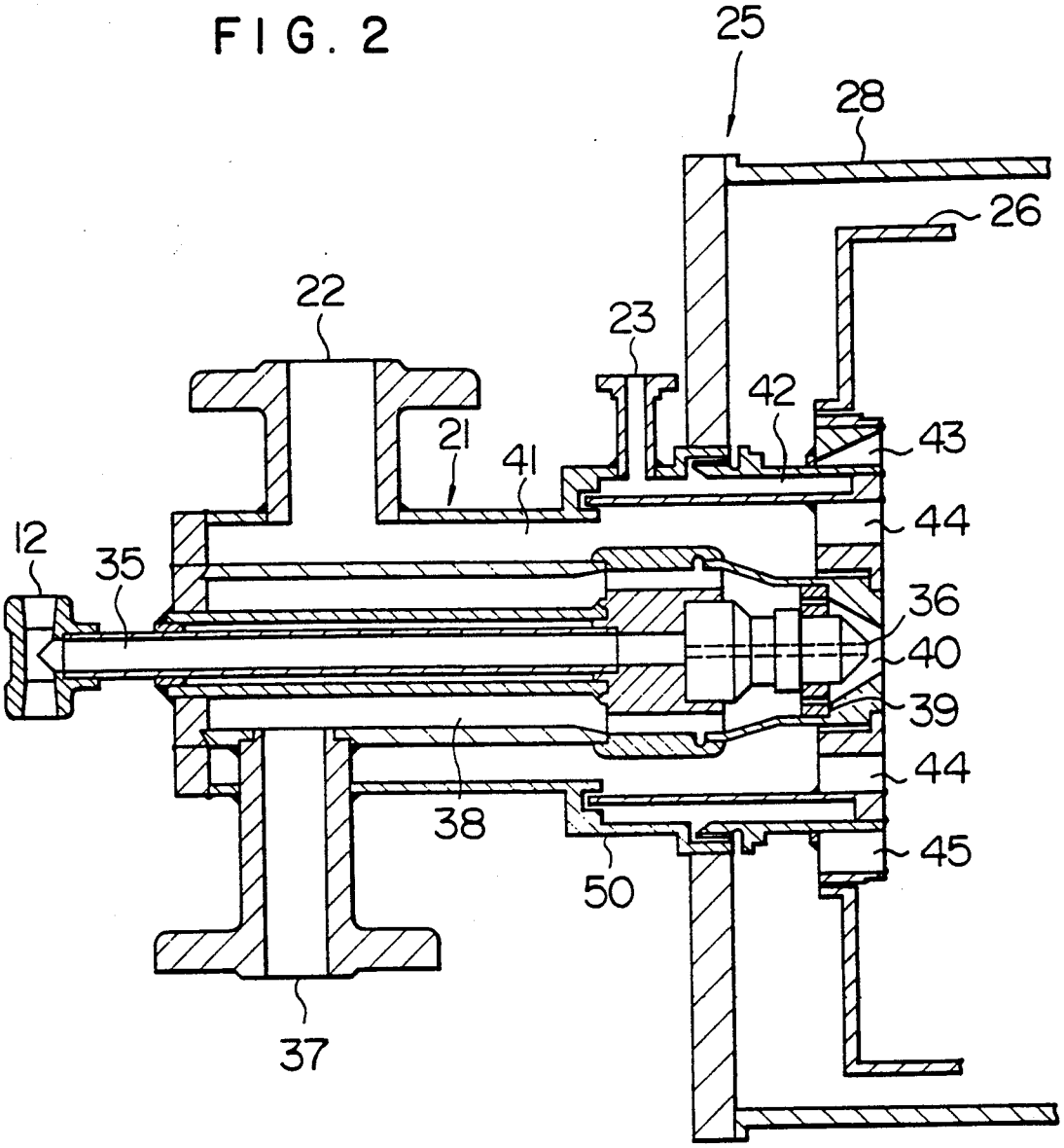
FIG. 2 illustrates the whole structure of a fuel nozzle which is applied to the burner of the invention.

FIG. 2 is a detailed sectional view of the fuel nozzle 21 that is a component of the burner 25. The fuel nozzle 25 comprises an oil (gas oil) feed system, coal gas feed system, and air feed system. The oil fuel introduced into the nozzle through an oil fuel inlet 12 is passed through a pass 35 and discharged in slick form into the burner liner 26 through an injection port 36 positioned at the front end of the nozzle. Spray air is used to convert this fuel in oil slick form into mist. Air pressurized by a spray air compressor 101 set up separately is passed through a spray air nozzle inlet 37, a spray air pass 38, and halfway a swirl vane to form an air vortex or to move spirally, and then is injected through a spray air outlet 40 positioned at the front end of the nozzle. This air strikes against the slick of oil discharged through the oil injection port 36, forming oil droplets of some dozens μm. These oil droplets are given the force of radial turning and the force of axial movement, spreading in conical form in front of the nozzle.

The pass for coal gas 10 is formed concentrically with the oil fuel pass 35 and around it. The coal gas fuel introduced into the nozzle body 50 through a main pass inlet 22 is passed through a main flow chamber 41 in the nozzle body and injected through main injection ports 44 with turning. On the other hand, the coal gas fuel introduced into the nozzle body 50 through a sub-pass inlet 23 is conducted to a sub-pass chamber 42 and injected through sub-injection ports 43. This injected coal gas need not move spirally, because it does not have direct effect on the stabilization of flame.

As to combustion air fed at the head of burner liner 26, the degree of mixing with fuel and the amount of air injected have great effect on the magnitude of the circulating stream mentioned before and therefore the positions of air injection ports are also important. In the invention, the combustion air is fed into the burner liner 26 through air injection ports 45 which has air-swirling blades symmetrically to the axis and is positioned at the peripheral portion of the nozzle body front.

Figure 3:
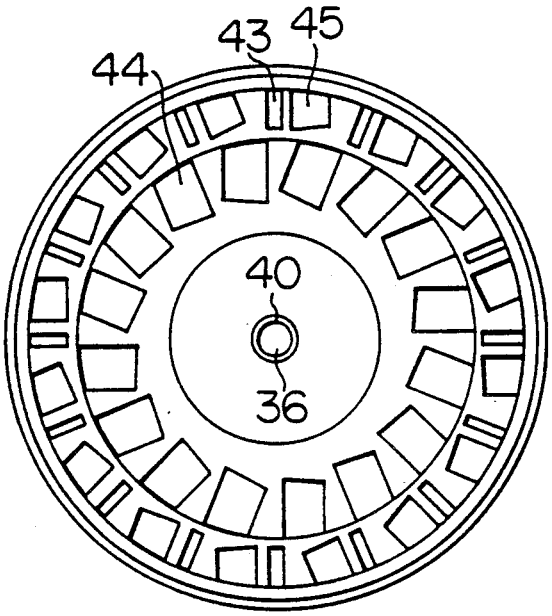
FIG. 3 is a front view of the fuel nozzle.

FIG. 3 is a front view of the fuel nozzle showing injection ports. The oil fuel injection port 36 is positioned at the center of the nozzle front and the spray air injection port 40 is formed around the oil fuel injection port 36. The main injection ports 44 for coal gas, the fuel flow from these ports having direct effect on the stability of flame, are situated in positions, somewhat distant from the center, necessary to stabilize the flame. On the other hand, the sub-injection ports 43, the fuel flow from these ports not having direct effect on the stability of flame, are situated in positions near the periphery of the nozzle body so as to minimize the effect of the fuel flow from these ports on the stability of flame. The main injection ports 44 and the sub-injection portions 43 are formed in the same fuel nozzle body. Air injection ports 45 are arranged around the main injection ports 44.

Figure 4:
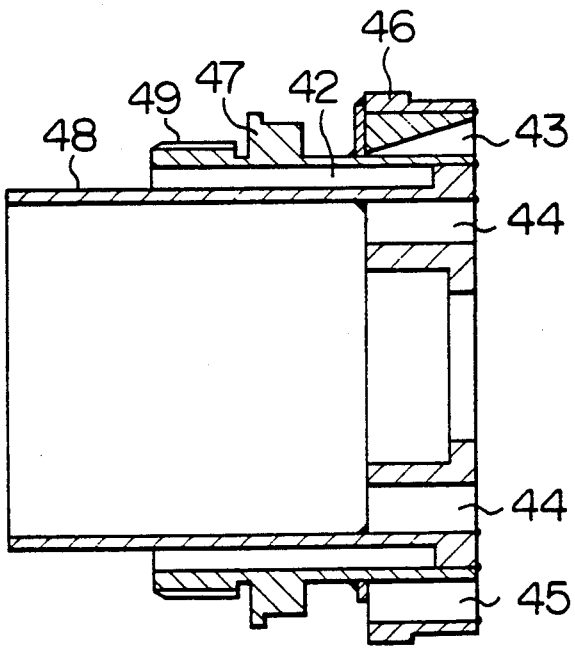
FIG. 4 is a sectional view of the injection port part of the fuel nozzle.

FIG. 4 is a detailed sectional view of the nozzle cap that is a front part of the nozzle. The nozzle cap is constructed of four members, which are welded to form a single body. The air injection ports 45 provided with air-swirling blades and the sub-injection ports 43 are formed in one member 47 and a ring 46 is welded to the outside of the member 47, thereby forming the air pass and the fuel sub-pass. A member 48 together with the member 47 forms the fuel sub-pass chamber 42. The member provided with the main injection ports is welded with the member 48. The main pass chamber 41 is surrounded by the member 48 and the outside wall of the spray air pass 38. The members 46 to 48 form a single body, which is fitted with a screw 49 into the fuel nozzle body 50. The streamline at the sub-injection ports 43 is parallel to the nozzle axis as well as to the streamline at the main injection port 44. However, the disorder of flame can be prevented by inclining the streamline at the sub-injection port 44.

It is necessary to decide the area of main injection ports in consideration of cases where the hydrogen content in the fuel is high. This is because the change in the rate of fuel injection relative to the change in the turbine load is about 0.5 at a load of 20% of the rated load and when this ratio is too low, a flashback or a blow off of flame may occur.

Figure 5:
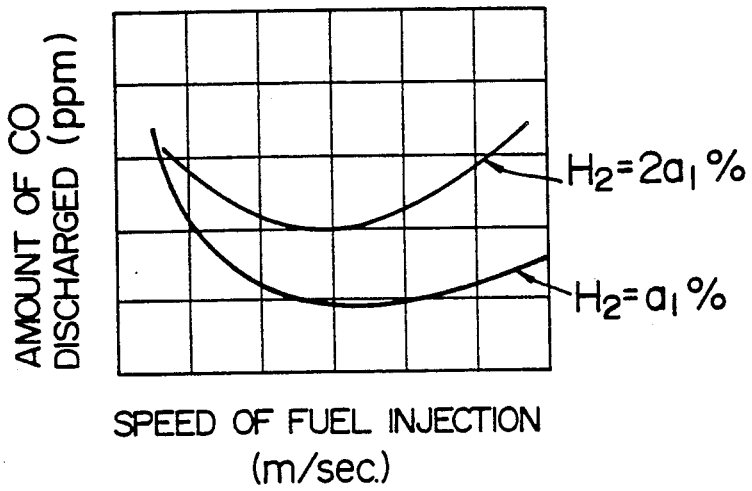
FIG. 5 show results of CO discharge tests conducted by using a conventional fuel nozzle.
Figure 6:
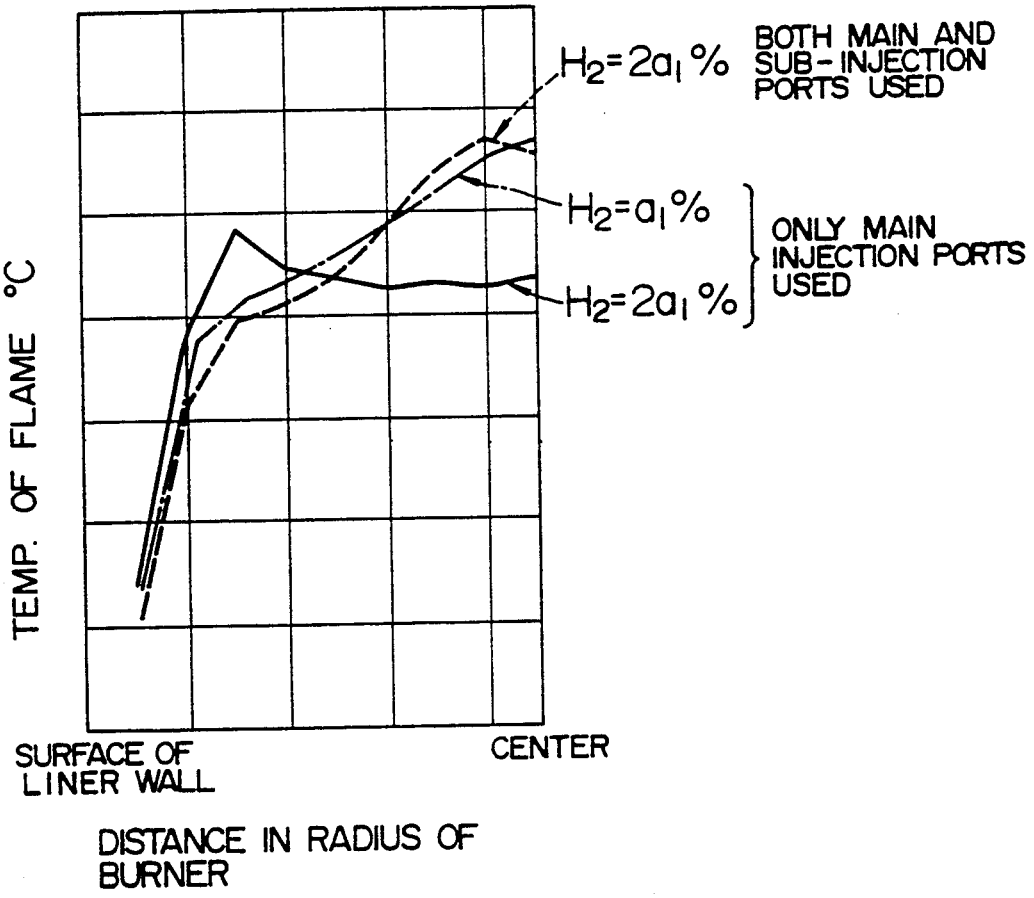
FIG. 6 shows results of measuring temperature distributions in flames generated in a burner of the invention.

FIGS. 5 and 6 show results of tests on a fuel nozzle as described above. FIG. 5 shows the relation between the speed of fuel injection and the amount of CO discharged where only the main injection ports 44 were used and the hydrogen content by volume in fuel was varied. FIG. 5 reveals that the amount of CO discharged increases with the speed of fuel injection through the main injection ports when the hydrogen content is high. In this case, moreover, the flame is unstable causing oscillating combustion.

Then, flame temperature distributions in the burner were measured to compare combustion states under different conditions. FIG. 6 shows results of the measurement. When only the main injection ports are used, the flame temperature distribution differs greatly with the hydrogen content. That is, when a hydrogen-rich fuel is used, the speed of fuel injection is excessive and hence the fuel is blown toward the inner wall of the burner, as shown by a solid line in FIG. 6, and the injected fuel stream does not match the circulating stream. This results in very unstable flame or oscillating combustion.

In contrast, when the hydrogen-rich fuel is fed through the main injection ports and the sub-injection ports, the flame temperature distribution, as shown by a dotted line, is nearly the same as found when a fuel of low hydrogen content is fed through the main injection ports only (shown by a dot-dash line), and the flame is stable.

Then, description is given on the application of the present inventive method to an actual producer gas power plant.

In a gas turbine driving burner, cooling air is fed to cool the wall of the burner liner. The feed position and amount of the cooling air are determined by the flame structure in the burner, hence being inherent in the burner. Therefore, when different species of fuel are burnt in the same burner, it is necessary to maintain the flame structure similar or stable as far as possible so that the wall temperature distribution in the burner liner may not vary.

On the other hand, the flame structure depends on the burning rate that is characteristic of the definite fuel used and as the burning rate is higher, the flame approaches a plane flame, i.e. the flame length decreases, the heat generated in the combustion zone: the so-called calorific capacity of combustion chamber increases. In this state, the temperature of the liner wall in contact with this combustion zone rises rapidly and the oscillation of burning tends to increase with the increasing calorific capacity of combustion chamber.

Such being the case, when different species of fuel are burnt in the burner, an improved fuel burner or some other device is necessary to maintain a good constant flame structure in the liner.

As stated above, the flame structure depends on the burning rate. Then, it is discussed below what the burning rate depends on.

In the case of a fuel such coal gas composed of plural inflammable gases and inert gases, it is considered that the proportion of inert gases and the proportion of hydrogen constituents have great effect on the burning rate.

Figure 7:
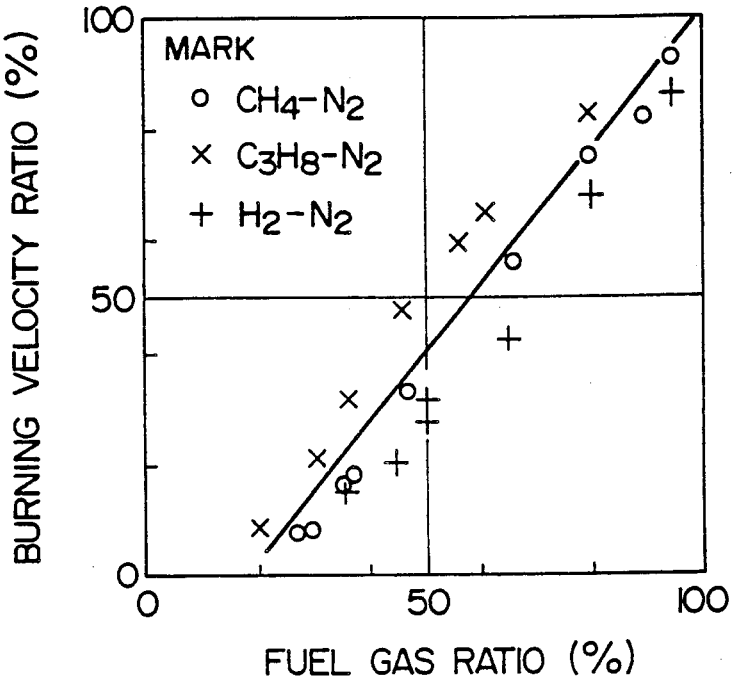
FIG. 7 shows the effect of inert gas content of the rate of combustion.

FIG. 7 shows the dependence of the burning rate on the fuel gas proportion in inert gas-fuel gas mixtures, determined experimentally by Morgan. The burning rate decreases with a decrease in the inflammable gas proportion, where the degree of this decrease in burning rate is not much affected by the kind of inflammable gas, that is, it may be considered that different inflammable gases have nearly the same tendencies to affect the burning rate.

Figure 8:
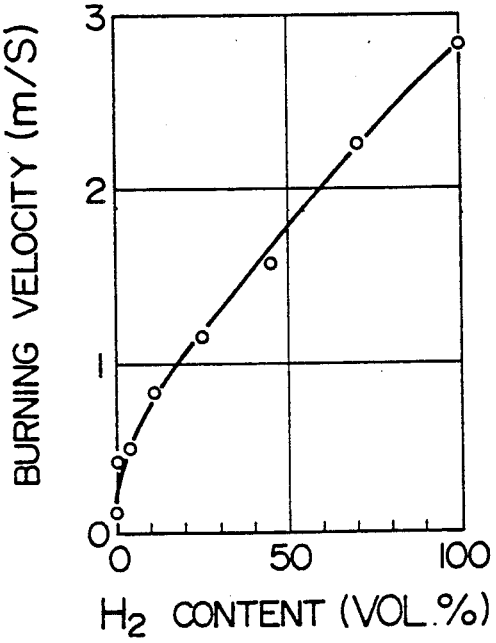
FIG. 8 shows combustion rates of $CO-H_2$ gas mixtures.

FIG. 8 shows burning rates of $CO$-$H_2$ gas mixtures, determined experimentally by Schote. This indicates that the high rate of burning $H_2$ gas itself and the resulting $H_2O$ increases the rate of burning CO.

Table 1 illustrates compositions of gases produced from different species of coal. The proportions of inflammable gases and inert gases differ with the species of coal.

TABLE 1

| Composition | Difference in gas composition with species of coal (Vol %) Coal No. C-1 | C-2 | C-3 | C-4 | C-5 | C-6 |
|---|---|---|---|---|---|---|
| $H_2$ | 11.2 | 8.9 | 11.2 | 8.9 | 8.6 | 11.8 |
| CO | 25.6 | 23.9 | 25.1 | 24.9 | 24.3 | 25.3 |
| $CO_2$ | 3.8 | 4.5 | 3.8 | 3.9 | 3.8 | 4.5 |
| $N_2$ | 56.0 | 59.1 | 56.7 | 59.6 | 60.3 | 55.0 |
| $H_2O$ | 2.4 | 3.5 | 2.9 | 2.9 | 2.9 | 3.1 |

Table 2 shows results of evaluating burning rates of gases having the above compositions on the basis of data of Schote's experiments (the burning rate of reference gas C-6 is assumed as 1), for the purpose of comparing the effect of $(H_2+CO)/N_2$ and the effect of $H_2/(CO+H_2)$ on the burning rate. It can be seen from Table 2 that the burning rate differs as much as 20% with the species of coal.

TABLE 2

| Composition | Difference in burning rate with species of coal Coal No. C-1 | C-2 | C-3 | C-4 | C-5 | C-6 |
|---|---|---|---|---|---|---|
| $\frac{H_2 + CO}{N_2} = r$ | 0.657 | 0.555 | 0.640 | 0.562 | 0.546 | 0.675 |
| Relative r | 0.974 | 0.823 | 0.949 | 0.833 | 0.809 | 1 |
| $\frac{H_2}{CO + H_2} = s$ | 0.304 | 0.271 | 0.308 | 0.266 | 0.261 | 0.318 |
| Relative s | 0.957 | 0.853 | 0.970 | 0.835 | 0.822 | 1 |
| Relative burning rate | 0.965 | 0.838 | 0.959 | 0.834 | 0.815 | 1 |
| Proportion of main feed | 96.5 | 83.8 | 96 | 83.4 | 81.5 | 100 |
| Proportion of sub-feed | 3.5 | 16.2 | 4 | 16.6 | 18.5 | 0 |

It may be understood from above that the flame structure can be maintained similar or stable, in the case of a fuel exhibiting a high burning rate, by injecting fuel at a high speed from the fuel nozzle so as to form a long flame and, in the case of a fuel exhibiting a low burning rate, by injecting fuel at a low speed to form a short flame. Applying this to results shown in Table 2, it is favorable that fuel from coal C-6 exhibiting the highest burning rate is fed through the main injection ports only and on the contrary, fuel from coal C-4 exhibiting a low burning rate is fed in a proportion of 16.6% through the sub-injection ports and in the remainder proportion (83.4%) through the main injection ports.

In the system shown in FIG. 1, a stable flame structure can be achieved by adjusting the travel of flow control valve 24 every time the species of coal is changed. A known hydrogen sensor can be used for the burning rate detector 100 of FIG. 1, since the burning rate can be evaluated indirectly by measuring the partial pressure of hydrogen in the fuel.

Alternatively, a known calorimeter may be used since a definite relationship exists between the calorific value of gaseous fuel and the burning rate thereof. In this case, the travel of the control valve is reduced as the calorific value of fuel increases.

According to the present invention, the fuel injection speed, which has direct effect on the stability of flame, can be controlled by using a regulater placed out of the fuel nozzle without altering the area of fuel injection ports, when the composition of gaseous fuel varies. Therefore, gaseous fuels different in composition can be burnt steadily without exchanging the burner or the fuel nozzle.

As a result, the gas turbine need not be stopped at every changeover to a gaseous fuel of different composition, that is, the plant can be operated continuously.

Moreover, since operation can be continued with the same fuel nozzle and the same burner, spare parts and the like can be reduced largely, resulting in better economy. In particular, gas turbine manufacturing costs can be reduced.

What is claimed is:

1. A method for burning gaseous fuel, the composition of the fuel varying at times, wherein the fuel is divided into a main part and a sub-part, which are then injected through main injection ports and sub-injection ports, respectively, into a combustion chamber, in which the fuel injected through the sub-injection ports is burnt by a flame produced from the fuel injected through the main injection ports, said method being characterized in that the flow ratio of the main part to the sub-part is controlled so that the proportion of the fuel to be injected through the main injection ports is increased as the composition of the gaseous fuel varies from one having a relatively lower burning rate to one having a relatively higher burning rate.

2. The method for burning gaseous fuel of claim 1, wherein the burning rate of the gaseous fuel is determined indirectly from the proportion of inert gas volume in the gaseous fuel, and as this proportion of inert gas volume decreases, the proportion of the fuel to be injected through the main injection port is increased.

3. The method for burning gaseous fuel of claim 1, wherein the burning rate of the gaseous fuel, when the gaseous fuel supplied is coal gas from a gas producer, is determined by previous experiments on every species of coal to be fed to the gas producer, and at every changeover of the feed coal, the proportion of the fuel to be injected through the main injection ports is altered on the basis of the previously determined rates of gaseous fuel burning.

* * * * *